US005386284A

United States Patent [19]

Kasahara et al.

[11] Patent Number: 5,386,284

[45] Date of Patent: Jan. 31, 1995

[54] IMAGE FORMING APPARATUS

[75] Inventors: Seitaro Kasahara; Haruo Itakura; Susumu Kurihara; Hiroshi Ishii, all of Tokyo, Japan

[73] Assignee: Konica Corporation, Tokyo, Japan

[21] Appl. No.: 93,002

[22] Filed: Jul. 19, 1993

Related U.S. Application Data

[63] Continuation of Ser. No. 729,899, Jul. 15, 1991, Pat. No. 5,278,623, which is a continuation of Ser. No. 536,467, Jun. 12, 1990, abandoned.

[30] Foreign Application Priority Data

| | | | |
|---|---|---|---|
| Jun. 21, 1989 | [JP] | Japan | 1-159086 |
| Jun. 29, 1989 | [JP] | Japan | 1-167890 |
| Jul. 10, 1989 | [JP] | Japan | 1-177590 |
| Jul. 10, 1989 | [JP] | Japan | 1-177591 |

[51] Int. Cl.[6] ..... G03G 15/01; G03G 21/00

[52] U.S. Cl. ..... 355/311; 355/208; 355/308; 355/309

[58] Field of Search ..... 355/311, 308, 309, 317, 355/321, 208, 203, 204, 243, 233; 271/270, 3

[56] References Cited

U.S. PATENT DOCUMENTS

| | | | |
|---|---|---|---|
| 4,129,377 | 12/1978 | Miyamoto et al. | 355/317 |
| 4,372,676 | 2/1983 | Miyata et al. . | |
| 4,420,246 | 12/1983 | Nonaka et al. . | |
| 4,455,081 | 6/1984 | Yoshimura et al. . | |
| 4,461,564 | 7/1984 | Ikenoue . | |
| 4,563,079 | 1/1986 | Inuzuka et al. . | |
| 4,664,503 | 5/1987 | Ibuchi | 355/311 |
| 4,707,111 | 11/1987 | Inuzuka et al. | 355/311 X |
| 4,714,941 | 12/1987 | Yamagishi et al. | 355/243 |
| 4,804,997 | 2/1989 | Mizude et al. . | |
| 4,879,578 | 11/1989 | Hisajima et al. | 355/309 X |
| 5,067,835 | 11/1991 | Yamamoto et al. | 355/311 X |
| 5,073,802 | 12/1991 | Sugiyama | 355/309 X |
| 5,099,287 | 3/1992 | Sato | 355/311 X |
| 5,150,224 | 9/1992 | Mizude et al. | 355/311 X |
| 5,206,689 | 4/1993 | Kusuda | 355/309 X |
| 5,278,623 | 1/1994 | Kasahara et al. | 355/317 |
| 5,282,001 | 1/1994 | Watson | 355/208 |

FOREIGN PATENT DOCUMENTS

| | | |
|---|---|---|
| 0261636 | 3/1988 | European Pat. Off. . |
| 2657426A1 | 6/1977 | Germany . |
| 2919784A1 | 11/1979 | Germany . |
| 3320734A1 | 12/1983 | Germany . |
| 3415593A1 | 10/1984 | Germany . |
| 3730601A1 | 3/1988 | Germany . |
| 14159 | 1/1983 | Japan . |
| 0035463 | 2/1986 | Japan . |
| 0175367 | 8/1987 | Japan . |
| 208065 | 9/1987 | Japan . |
| 13349 | 11/1989 | Japan . |

*Primary Examiner*—Matthew S. Smith

*Attorney, Agent, or Firm*—Finnegan, Henderson, Farabow, Garrett & Dunner

[57] ABSTRACT

An image forming apparatus wherein a recording medium stored in a storage device is first detected by a detection device and the recording medium is abutted against a second paper feed roller, the second paper feed roller being driven by a controller for feeding the abutted recording medium to an image forming unit, at the timing at which the tip of an image in the image forming unit is in accord with the tip of the recording medium for each of the size of the recording medium.

1 Claim, 5 Drawing Sheets

IMAGE FORMING APPARATUS

This is a continuation of application Ser. No. 07/729,899 now U.S. Pat. No. 5,278,623, filed Jul. 15, 1991, which is a continuation of Ser. No. 07/536,467, filed Jun. 12, 1990 now abandoned.

BACKGROUND OF THE INVENTION

1. Field of the Invention

This invention relates to an image forming apparatus which is equipped with storage means for storing a recording medium, and feed means including first and second paper feed rollers, said first paper feed roller delivering the recording medium from the storage means and abutting it to said second paper feed roller and said second paper feed roller feeding the abutted recording medium to an image forming unit.

The present invention relates also to an image forming apparatus which includes scanning means for scanning a document placed on a document glass plate, scan-driving means for driving this scanning means, storage means for storing a recording medium, detection means for detecting the size of the recording medium stored in the storing means and feed means for feeding the recording medium, and which forms an image on the fed recording medium by use of image information obtained by the scanning means.

2. Description of the Prior Art

A prior art example will be explained with reference to the accompanying drawings. FIG. 6 is a structural view of an electrophotographic reproducing apparatus as a prior art example.

In FIG. 6, a document glass plate 1 which is made of transparent glass and on which a document D is to be placed is disposed at the center of the upper portion of a reproducing apparatus main body and a scale plate 2 for designating the placement position in accordance with the size of the document D is disposed at the left end of the document glass plate 1. A document cover 3 capable of covering the document D placed on the document glass plate 1 is disposed at the upper part of this plate 1 in such a manner as to be capable of turning down forwardly. The document D is placed on the document glass plate 1 in match with the scale designated by the scale plate 2 and when covered with the document cover 3, its movement is restricted.

A first mirror unit 6 equipped with an exposure lamp 4 and a first mirror 5 is disposed below the document glass plate 1 and inside the reproducing apparatus main body in such a manner as to be capable of moving linearly to the right and left in FIG. 6 in parallel with the document glass plate 1, and capable of scanning the full surface of the document D. A second mirror unit 9 formed by integrating second and third mirrors 7 and 8 can linearly move to the right and left in FIG. 4 and in parallel with the document glass plate 1 at the speed which is the half of the first mirror unit 6 in such a manner as to keep a predetermined optical path length. A main lens 10 is the lens to which the reflected rays of light from the document D on the document glass plate 1 are incident after being reflected by the first, second and third mirrors 5, 7, 8, and the rays of light leaving this main lens 10 are incident into a photosensitive drum 12 as an image retainer through a fourth mirror 11 and through a slit 13. These first and second mirror units 6 and 9 are driven by an optical system driving motor not shown in the drawing.

A charging electrode 14 charges uniformly the photosensitive drum 12. Accordingly, electrostatic latent images are formed sequentially on the photosensitive drum 12 rotating clockwise in FIG. 6 due to the incidence of rays of light from the optical system described above. A developing device 15 converts the electrostatic latent image on this photosensitive drum 12 to a visible toner image.

On the other hand, a paper feeder for feeding transfer paper comprises a paper cassette 16 for storing transfer paper (recording medium) P, a first paper feed roller 17 for delivering one by one this transfer paper P from the paper cassette 16, a second paper feed roller 18 for feeding delivered transfer paper P to the photosensitive drum 12 side, and guide plates 19 and 20 disposed between the paper cassette 16 and the second paper feed roller 18 and between the second paper feed roller 18 and a transfer electrode which will be described later. At the time of reproduction, transfer paper P inside the paper cassette 16 is delivered by the first paper feed roller 17 and is abutted against the second paper feed roller 18 while being guided by the guide plate 19. The second paper feed roller 18 is driven by a paper feed timing signal which brings the tip of the toner image on the photosensitive drum 12 into conformity with the tip of transfer paper P.

A transfer electrode 21 transfers the toner image on the photosensitive drum 12 onto transfer paper P and a separating electrode 22 separates transfer paper P from the photosensitive drum 12. Transfer paper P separated there is sent to a fixing device 24 through transfer paper conveyor means 23, is subjected to fusion-fixing by a heat-fixing roller and a press roller and is thereafter discharged by a paper discharge roller 25 onto a paper tray 26. These first paper feed roller 17, second paper feed roller 18, photosensitive drum 12 and paper discharge roller 25 are driven by a paper feed system driving motor which is not shown in the drawing.

After the transfer step is complete, the toner remaining on the photosensitive drum 12 is removed by a cleaning device 27. In order to make this removal easy, a cleaning/charge eliminating electrode 28 for effecting A.C. corona discharge is disposed at its pre-stage. A charge eliminating unit 29 for erasing the charge of the non-image portions is disposed at the post-stage of the charging electrode 14 so as to prevent the toner from attaching to the non-image portions and in such a manner as to face the photosensitive drum 12. Incidentally, reference numerals 30 and 31 represent a precharge exposure unit and an exposure unit before transfer, respectively.

In the prior art example having the construction described above, the second paper feed roller 18 is driven by the paper feed timing signal such that the tip of the toner image on the photosensitive drum 12 is in conformity with the tip of transfer paper P. This timing signal is generated from a timing sensor, not shown, when the first mirror unit 6 reaches a predetermined position.

If the size of transfer paper P is different at the time of the feed of paper by the second paper feed roller, however, the load of frictional resistance by the first paper feed roller 17 and the guide plate 19 becomes different. Accordingly, there is a problem that the tip of the toner image on the photosensitive drum 12 is not in conformity with the tip of transfer paper P depending on the size of recording paper P.

If the paper cassette 16 has a two-stage structure, the timing signal is generated at the same timing for both transfer paper P which is supplied from the paper cassette 16 of the upper stage and transfer paper P which is supplied from the paper cassette 16 of the lower stage.

However, the paper feed path (the route from each paper cassette 16 to the second paper feed roller 18) is different between transfer paper P supplied from the paper cassette 16 of the upper stage and transfer paper P supplied from the paper cassette 16 of the lower stage. Since transfer paper P is fed while it keeps sliding contact with the paper feed path, a delicate sliding difference occurs on the second paper feed roller 18 depending on the level of the frictional resistance to transfer paper P and therefore the problems occurs in that the tip of the toner image on the photosensitive drum 12 does not coincide with the tip of transfer paper P.

In the prior art example having the construction described above, transfer paper P is supplied while keeping sliding contact with the paper feed path. Accordingly, if the size of transfer paper P is different at the time of the paper feed by the second paper feed roller 18, the load of the frictional resistance due to the first paper feed roller 17 and the guide plate 19 varies. This difference of the size of transfer paper P causes a delicate sliding difference of the second paper feed roller 18 and results in the difference of the paper feed speed.

On the other hand, the optical system (scanning system) and the paper feed system are driven by separate motors, respectively. Therefore, there is a problem that the length of an image of the document D in the paper feed direction obtained by scanning is different from the length of an image in the paper feed direction transferred onto transfer paper P depending on the size of transfer paper P.

In the prior art example having the construction described above, the paper feed path (the route from each paper cassette 16 to the second paper feed roller 18) is different between transfer paper P supplied from the paper cassette 16 of the upper stage and transfer paper P supplied from the paper cassette 16 of the lower stage. Since transfer paper P is supplied while keeping sliding contact with the paper feed path, a delicate sliding difference occurs at the second paper feed roller 18 depending on the level of the frictional resistance to transfer paper P and a difference of the paper feed speed occurs depending on the position of the paper feed cassette 16.

However, since the optical system (scanning system) and the paper feed system are driven by separate motors, respectively, there occurs a problem that the length of the image of the document D in the paper feed direction obtained by scanning is different from the length of the image transferred actually onto transfer paper P in the paper feed direction depending on the position of the paper cassette 16.

In the case of a certain copying machine wherein a three-stage paper cassette 16 is provided, for example, the length of the image transferred to transfer paper P of an A3 size of an intermediate stage in the paper feed direction becomes shorter by 0.3% in comparison with transfer paper P of the A3 size of the paper cassette of the upper stage. Similarly, the length of the image transferred to transfer paper of an A4R size of the paper cassette of the upper stage in the paper feed direction becomes longer by 0.1%.

SUMMARY OF THE INVENTION

In view of the problems with the prior art technique described above, the present invention is directed to provide an image forming apparatus which can bring the tip of a toner image on a photosensitive drum into conformity with the tip of a recording medium supplied, irrespective of the size of the recording medium.

The image forming apparatus in accordance with the present invention for solving the problems described above comprises storage means for storing a recording medium, feeding means including first and second paper feed rollers, said first paper feed roller delivering the recording medium from the storage means and abutting it against said second paper feed roller, and said second paper feed roller feeding the abutted recording medium to an image forming unit, detection means for detecting the size of the recording medium stored in the storage means and control means for driving the second paper feed roller at the timing at which the tip of the image in the image forming unit is in conformity with the tip of the recording medium, for each of the size of the recording medium.

In the image forming apparatus of the present invention, the size of the recording medium stored in the storage means is first detected by the detection means. Next, the recording medium stored in the storage means is abutted against the second paper feed roller by the first paper feed roller. The control unit drives the second paper feed roller at the timing at which the tip of the image in the image forming unit coincides with the tip of the recording medium.

It is another object of the present invention to provide an image forming apparatus which can supply the recording medium to the image forming unit at the same timing irrespective of the position of the storage means of the recording medium.

The image forming apparatus in accordance with the present invention for accomplishing the object described above comprises a plurality of storage means for storing recording mediums, selection means for selecting one of the plurality of storage means, feeding means including first and second paper feed rollers, said first paper feed roller delivering the recording medium from the selected storage means and abutting it against said second paper feed roller, and said second paper feed roller feeding the abutted recording medium to an image forming unit, and control means for driving the second paper feed roller at the timing at which the tip of the image in the image forming unit coincides with the tip of the recording medium, for each of the plurality of storage means.

In the image forming apparatus of the present invention, the recording medium to be supplied is selected by the selection means from a plurality of storage means.

Next, the selected recording medium is abutted against the second paper feed roller by the first paper feed roller.

The control unit drives the second paper feed roller at the timing at which the tip of the image in the image forming unit coincides with the tip of the recording medium, for each of a plurality of storage means.

It is still another object of the present invention to provide an image forming apparatus which does not generate a difference of the driving speed between a paper feed system and a scanning system irrespective of the size of the recording medium.

The image forming apparatus in accordance with the present invention for accomplishing the object described above comprises scanning means for scanning a document set on a document glass plate, scan-driving means for driving this scanning means, storage means for storing a recording medium, detection means for detecting the size of the recording medium stored in the storage means, feed means for feeding the recording medium, and control means for controlling the scan-driving means for each size of the recording medium so that the feed speed of the feed means is in conformity with the driving speed of the scan-driving means, and wherein an image is formed on the recording medium fed by use of image data obtained by the scanning means.

In the image forming apparatus of the present invention, the size of the recording medium stored in the storage means is detected by the detection means. The recording medium is supplied by the feed means.

On the other hand, the document set onto the document glass plate is scanned by the scanning means which is driven by the scan-driving means and the image is formed on the recording medium fed by use of the resulting image signal.

At this time the control unit controls the scan-driving means for each size of the recording medium so that the feed speed of the feed means is in match with the driving speed of the scan-drive means.

It is still another object of the present invention to provide an image forming apparatus which does not generate a difference of the driving speed between the feed system and the scanning system irrespective of the position of the storage means of the recording medium.

The image forming apparatus in accordance with the present invention for accomplishing the object described above comprises scanning means for scanning a document set to a document glass plate, scan-driving means for driving this scanning means, a plurality of storage means for storing recording mediums, selection means for selecting one of the storage means, feed means for feeding the selected recording medium, and control means for controlling the scan-driving means for each of a plurality of storage means so that the feed speed of the feed means is in match with the driving speed of the scan-driving means, and wherein an image is formed on the recording medium fed by use of image data obtained by the scanning means.

In the image forming apparatus of the present invention, the recording medium to be fed is first selected from a plurality of storage means by use of the selection means and the selected recording medium is fed by the feed means.

On the other hand, the document set onto the document glass plate is scanned by the scanning means driven by the scan-driving means, and the image is formed on the recording medium fed by use of the resulting image signal.

At this time, the control unit controls the scan-driving means for each of a plurality of storage means so that the feed speed of the feed means is in match with the driving speed of the scan-driving means.

These and other objects and novel features of the present invention will become more apparent from the following description when taken in conjunction with the accompanying drawings.

DESCRIPTION OF THE PREFERRED EMBODIMENTS

Figure 2:
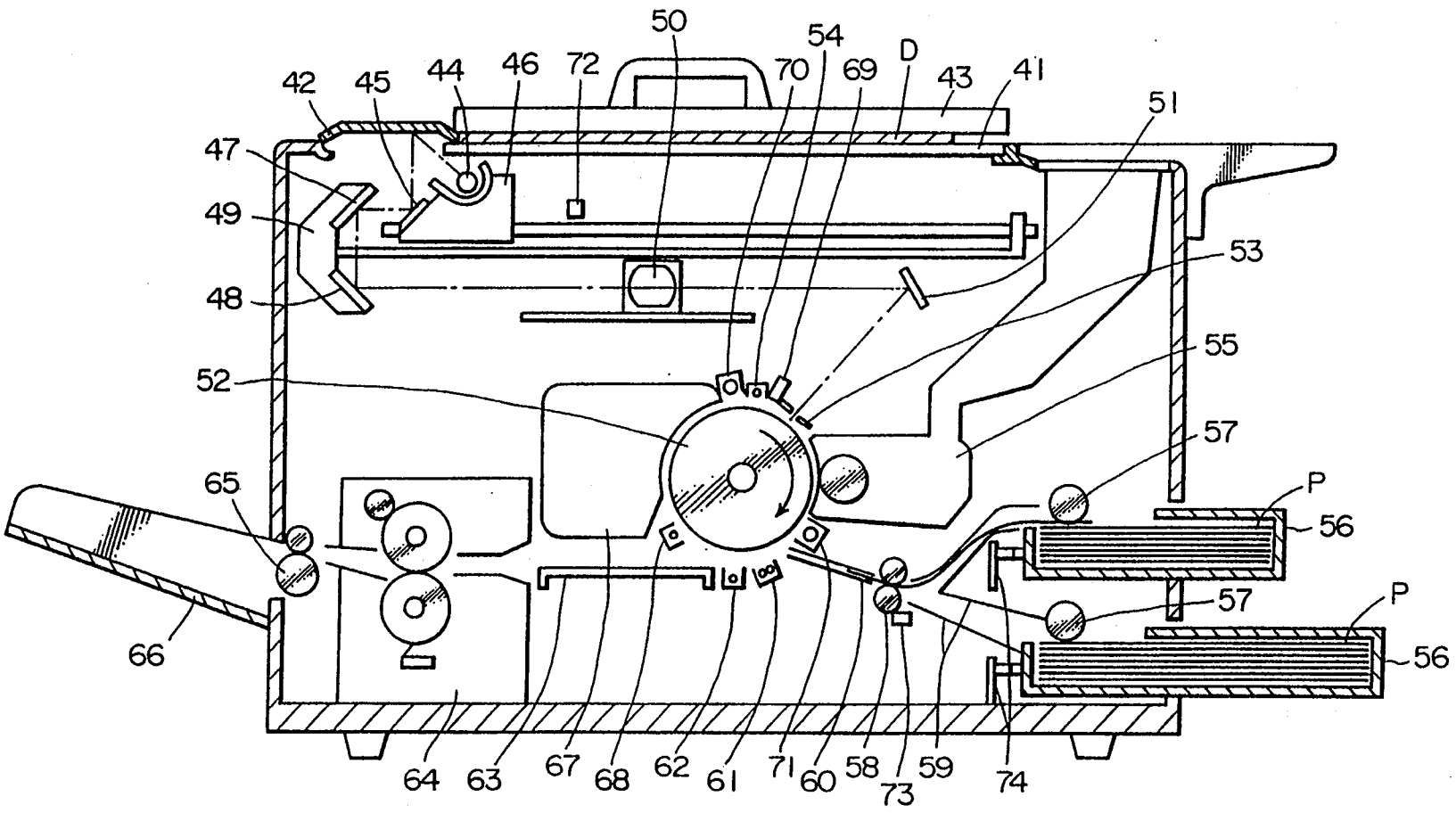
FIG. 2 is a structural view showing a mechanical construction in FIG. 1.

First of all, the mechanical construction of the present invention will be explained with reference to FIG. 2. In FIG. 2, a document glass plate 41 on which a document D is placed and which is made of transparent glass is disposed at the center on a reproducing apparatus main body and a scale plate 42 for designating the placement position of the document D in accordance with its size is disposed at the left end of the document glass plate 41. Further, a document cover 43 for covering the document D placed on the document glass plate 41 is disposed at the part of the glass plate 41, in such a manner as to be capable of turning down forwardly. The document D is placed on the document glass plate 41 in accordance with the scale designated by the scale plate 42 and when covered with the document cover 43, its movement is restricted.

A first mirror unit 46 equipped with an exposure lamp 44 and a first mirror 45 is disposed below the document glass plate 41 and inside the reproducing apparatus main body in parallel with the document glass plate 41 and in such a manner as to be capable of moving linearly to the right and left in FIG. 2 and to scan the full surface of the document D. A second mirror unit 49 formed by integrating second and third mirrors 47 and 48 is allowed to move linearly to the right and left in FIG. 2 and in parallel with the document glass plate 41 at the speed of ½ of the first mirror unit 46. These mirror units 46 and 49 are driven by an optical system motor 100 and this motor is in turn driven variably by a driving circuit 101 of a PLL control system. A main lens 50 is the lens to which the reflected rays of light from the document D on the document glass plate 41 are incident after being reflected by the first, second and third mirrors 45, 47, 48, and the rays of light leaving this main lens 50 are incident into a photosensitive drum 52 as an image retainer through a fourth mirror 51 and a slit 53.

A charging electrode 54 charges uniformly the photosensitive drum 52. Accordingly, electrostatic latent images are formed sequentially on the photosensitive drum 52 rotating clockwise in FIG. 2 due to the incidence of rays of light from the optical system described above. A developing device 55 converts the electrostatic latent image on the photosensitive drum 52 to a visible toner image.

On the other hand, a paper feed device for feeding transfer paper P consists of paper cassettes 56 (two cassettes are shown in FIG. 2) for storing transfer paper P (recording medium), a first paper feed roller 57 for delivering one by one transfer paper P from the paper cassette 56, a second paper feed roller 58 for feeding the delivered transfer paper P to the photosensitive drum 52 side, and guide plates 59 and 60 disposed between the paper cassette 56 and the second paper feed roller 58 and between the second paper feed roller 58 and a later-appearing transfer electrode. At the time of reproduction, transfer paper P inside the selected paper cassette 56 is delivered by the first paper feed roller 57, is guided by the guide plate 59 and then abutted against the second paper feed roller 58. The second paper feed roller 58 is driven by a paper feed timing signal from a control unit 76 so that the tip of the toner image on the photosensitive drum 52 is in comformity with the tip of transfer paper P.

A transfer electrode 61 transfers the toner image on the photosensitive drum 52 to transfer paper P and a separating electrode 62 separates transfer paper P from the photosensitive drum 52. Transfer paper P separated here is sent to a fixing device 64 through transfer paper conveyor means 63, is subjected to fusion-fixing by a heat fixing roller and a press roller and is thereafter discharged onto a tray 66 by a paper discharge roller 65. After the transfer step is complete, the toner remaining on the photosensitive drum 52 is removed by a cleaning device 67. To facilitate this removal, a cleaning/charge eliminating electrode 68 for effecting A.C. corona discharge is disposed at a prestage. A charge of eliminating unit 69 for eliminating the charge of non-image portions by light is disposed at the post-stage of the charge electrode 54 in such a manner as to face the photosensitive drum 52, in order to prevent adhesion of the toner to the non-image portions. Incidentally, reference numerals 70 and 71 represent a precharge exposure unit and an exposure unit before transfer, respectively.

Further, reference numeral 72 represents a timing sensor responsive to the arrival of the first mirror unit 46 at a predetermined position and reference numeral 73 represents a clutch of a solenoid driving type which transmits or cuts off the driving force to the second paper feed roller 58.

Reference numeral 74 represents a transfer paper size detector for detecting the size of transfer paper P stored in the paper cassette 56.

Figure 3:
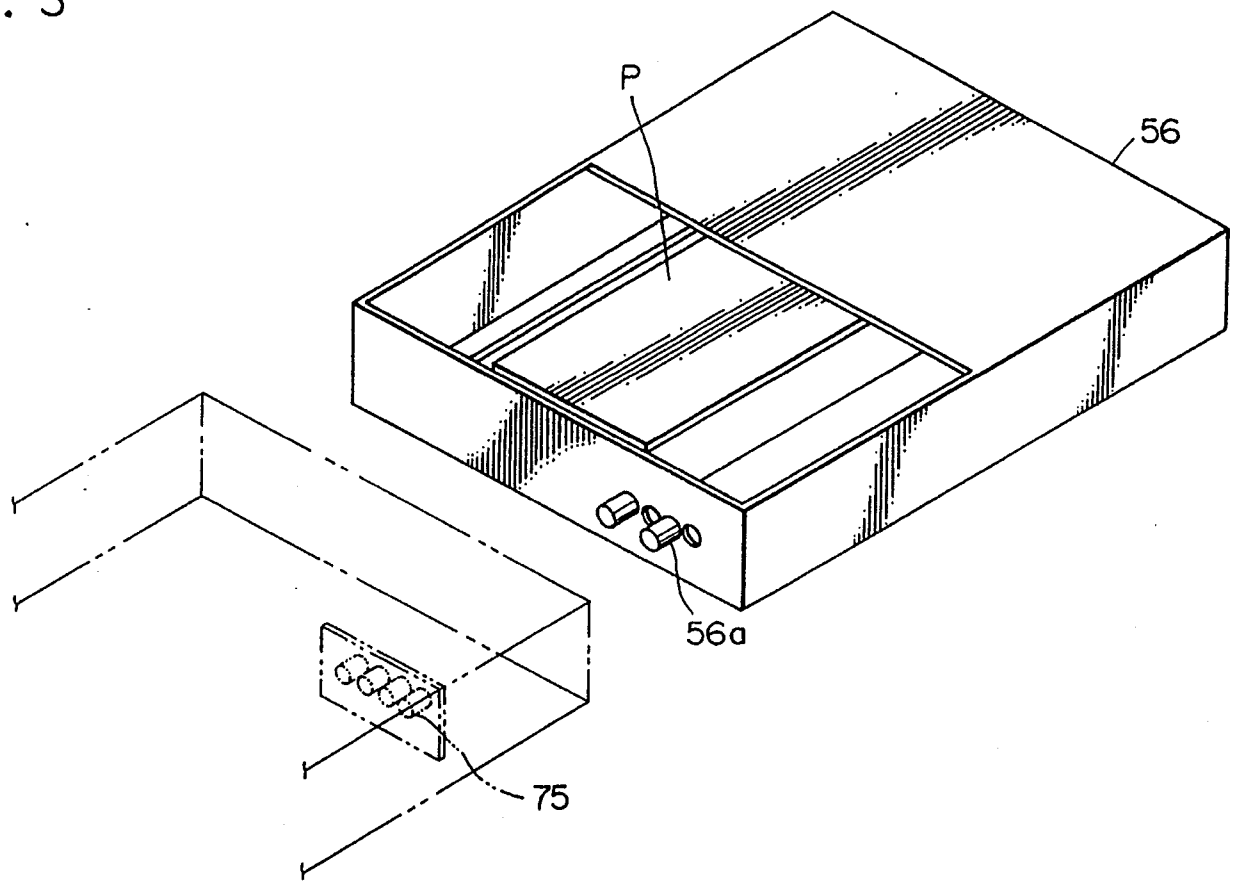
FIG. 3 is a structural view of a transfer paper size detector in FIG. 1.

Here, the transfer paper size detector 74 will be explained with reference to FIG. 3. In FIG. 3, maximum four protuberances 56*a* corresponding to the sizes of transfer paper P are fitted to the tip surface of the paper cassette 56. On the other hand, four microswitches 75 are disposed on the apparatus side. When the paper cassette 56 is set to the apparatus, the protuberances 56*a* push the microswitches 75. The size of transfer paper P is detected by the kind of this pushed microswitch 75.

Figure 1:
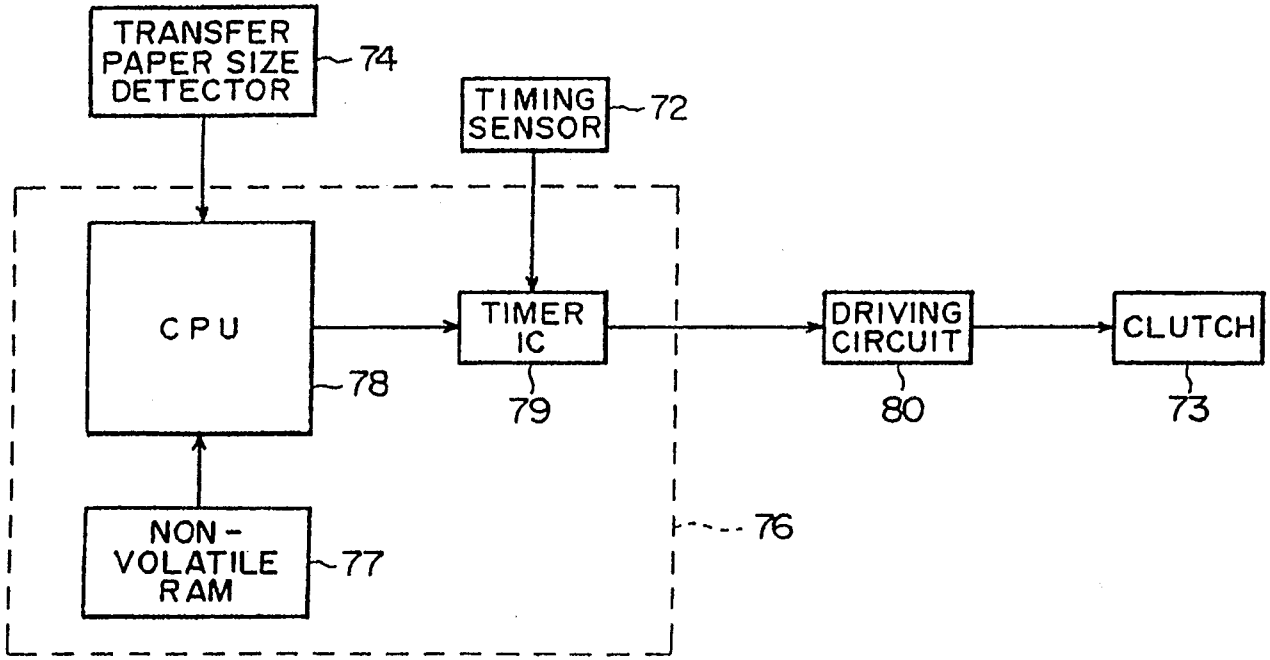
FIG. 1 is a block diagram showing the principal portions of an embodiment of the present invention.

Next, the circuit construction of the principal portions of this embodiment will be explained with reference to FIG. 1. In FIG. 1, reference numeral 76 represents a control unit of the reproducing apparatus. This control unit 76 is provided with a non-volatile RAM 77, into which the driving timing data of the second paper feed roller 58 for each size of transfer paper P, that are determined in advance, are written and with a CPU 78 which reads out the data written into the non-volatile RAM 77 and sets the data to a timer IC 79.

Reference numeral 80 represents a driving circuit for driving a solenoid of a clutch 73.

Next, the operation of the construction described above will be explained. A difference of this embodiment from the prior art example lies in the paper feed operation from the second paper feed roller 58 to the photosensitive drum 52. Since the rest of the operations are the same as those in the prior art example, their explanations will be omitted.

Predetermined data which permit the tip of the toner image on the photosensitive drum 52 to become coincident with the tip of transfer paper P fed are written into the non-volatile RAM 77 for each size of transfer paper P at the time of assembly or maintenance in consideration of the load of the frictional resistance of the guide plates 59, 60, and the like.

First of all, the control unit 76 receives the size data of transfer paper P stored in the paper cassette 56 from the transfer paper size detector 74. Next, CPU 78 selects the data corresponding to the size of transfer paper P from the non-volatile RAM 77 and sets them to the timer IC 79. When the first mirror unit 46 starts scanning and reaches a predetermined position, the timing sensor 72 responds to this arrival and provides the timing signal to the timer IC 79. Receiving a timing signal, the timer IC 79 actuates the driving circuit 80 on the basis of the set data. When the driving circuit 80 operates, the solenoid of the clutch 73 operates and the second paper feed roller 58 feeds transfer paper P to the photosensitive drum 52.

According to the construction described above, it is possible to feed transfer paper P to the photosensitive drum 52 at the same timing irrespective of the size of transfer paper P.

The present invention is not particularly limited to the embodiment described above, and can be applied to an image forming apparatus having not only one-stage paper cassette but also a plurality of sets of cassettes. In this case, data corresponding to (number of stages of cassettes X sizes of transfer paper P) are recorded into the non-volatile RAM 77, and the control unit 76 receives the position data of the selected paper cassette 56 and the size data of transfer paper P and selects the corresponding data from the non-volatile RAM 77.

Furthermore, the present invention is not particularly limited to the reproducing apparatus but can of course be applied to other image forming apparatuses such as a laser beam printer.

As described above, since the present invention disposes the detection means for detecting the size of the recording medium stored in the storage means and the control means for driving the second paper feed roller at the timing at which the tip of the image in the image forming unit and the tip of the recording medium are in conformity with each other, for each size of the recording medium, the present invention can accomplish the image forming apparatus which can bring the tip of the toner image on the photosensitive drum into conformity with the tip of the recording medium fed irrespective of the size of the recording medium.

In another embodiment of the present invention, the driving timing data of the second paper feed roller 58 that are determined in advance depending on the position of the paper cassette 56 are written into the non-volatile RAM 77 of the control unit 76 of the reproducing apparatus and CPU 78 reads out the data written into the non-volatile RAM 77 and sets them to the timer IC 79.

The apparatus has cassette selection means (not shown) including a switch which is disposed on the main panel for selecting whether transfer paper P of the upper paper cassette 56 or transfer paper P of the lower cassette 56 is to be fed.

In this embodiment, the predetermined data which permit the feed of transfer paper P to the photo-sensitive drum 52 at the same timing irrespective of the position of the paper cassette 56 are written into the non-volatile RAM 77 at the time of assembly or maintenance in consideration of the load of the frictional resistance of the guide plates 59, 60, and the like.

First of all, the operator decides whether transfer paper P of the upper paper cassette 56 or transfer paper P of the lower paper cassette 56 is to be used, by use of the cassette selection means. At this time, the data of the selected paper cassette 56 is received by CPU 78 and CPU 78 selects the data corresponding to the selected paper cassette 57 from the non-volatile RAM 77 and sets them to the timer IC 79. When the first mirror unit 46 starts scanning and then reaches a predetermined position, the timing sensor 72 operates in response thereto and provides the timing signal to the timer CI 79. Receiving the timing signal, the timer IC 79 actuates the driving circuit 80 on the basis of the set data. When the driving circuit 80 operates, the solenoid of the clutch 73 operates and the second paper feed roller 58 feeds the transfer paper P to the photo-sensitive drum 52.

According to the construction described above, transfer paper P can be supplied to the photosensitive drum at the same timing irrespective of the set position of the paper cassette 56.

In an apparatus having a temporary stacker for effecting double-face reproduction, variance of timing can be eliminated by writing into the non-volatile RAM those data which take into consideration the frictional resistance of the feed path from the stacker to the photosensitive drum.

According to this embodiment, since the control means for driving the second paper feed roller at the timing at which the tip of the image in the image forming unit is in conformity with the tip of the recording medium is disposed for each of a plurality of storage means, it is possible to accomplish the image forming apparatus capable of supplying the recording medium to the image forming unit at the same timing irrespective of the position of the storage means of the recording medium.

Figure 4:
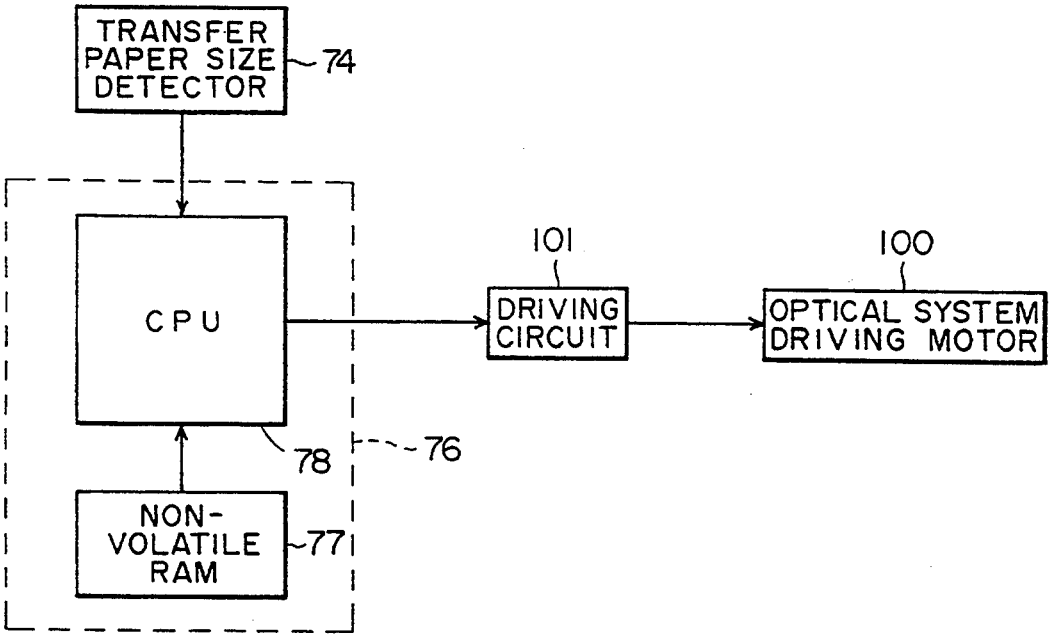
FIGS. 4 and 5 are block diagrams, each showing the principal portions of other embodiments of the present invention.

In still another embodiment of the present invention shown in FIG. 4, the driving speed data of the scanning system which brings the driving speed of the scanning system into conformity with the driving speed of the feed system for each size of transfer paper P are written into the non-volatile 4 77 at the time of its assembly or maintenance in consideration of the load of the frictional resistance of the guide plates 59, 60, and the like.

First of all, the control unit 76 receives the size data of transfer paper P stored in the paper cassette 56 from the transfer paper size detector 74. Next, CPU 78 selects the data corresponding to the size of transfer paper P from the non-volatile RAM 77 and sets it to the driving circuit 101. The optical system driving motor 100 is then driven on the basis of this data.

According to the construction described above, the driving speed of the feed system can be brought into conformity with the driving speed of the optical system irrespective of the size of transfer paper P. Accordingly, no difference occurs between the length of the image of the document D in the feed direction obtained by scanning and the length of the image in the feed direction transferred onto transfer paper P.

As described above, since this embodiment includes the control means for controlling the scan-driving means for each size of the recording medium so that the feed speed of the feed means is in conformity with the driving speed of the scan-driving means, it is possible to accomplish the image forming apparatus which does not generate the difference of the driving speed between the feed system and the scanning system irrespective of the size of the recording medium.

Figure 5:
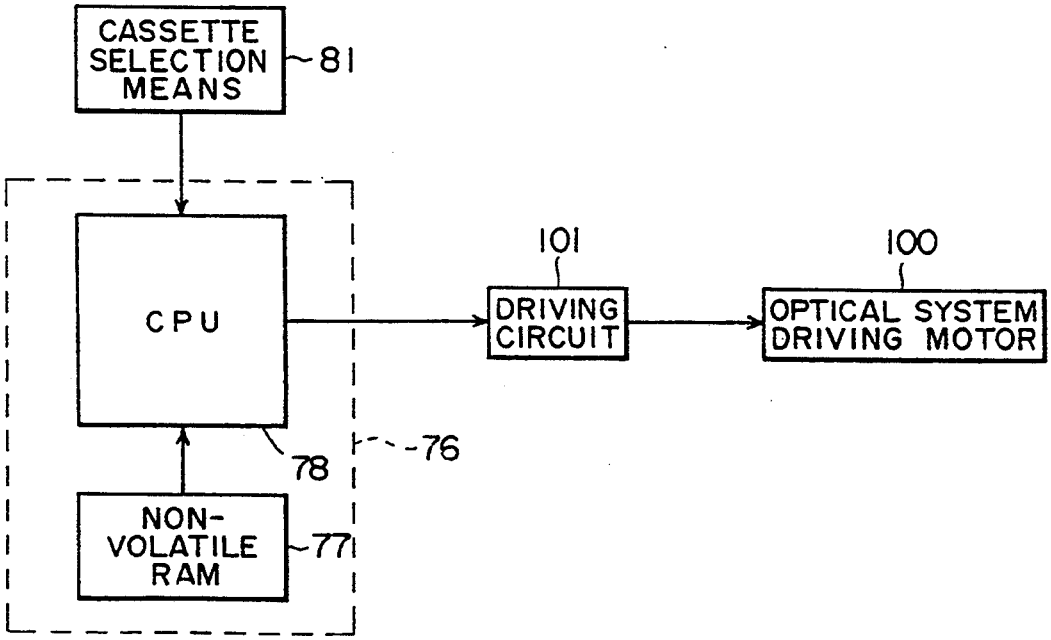
Figure 6:
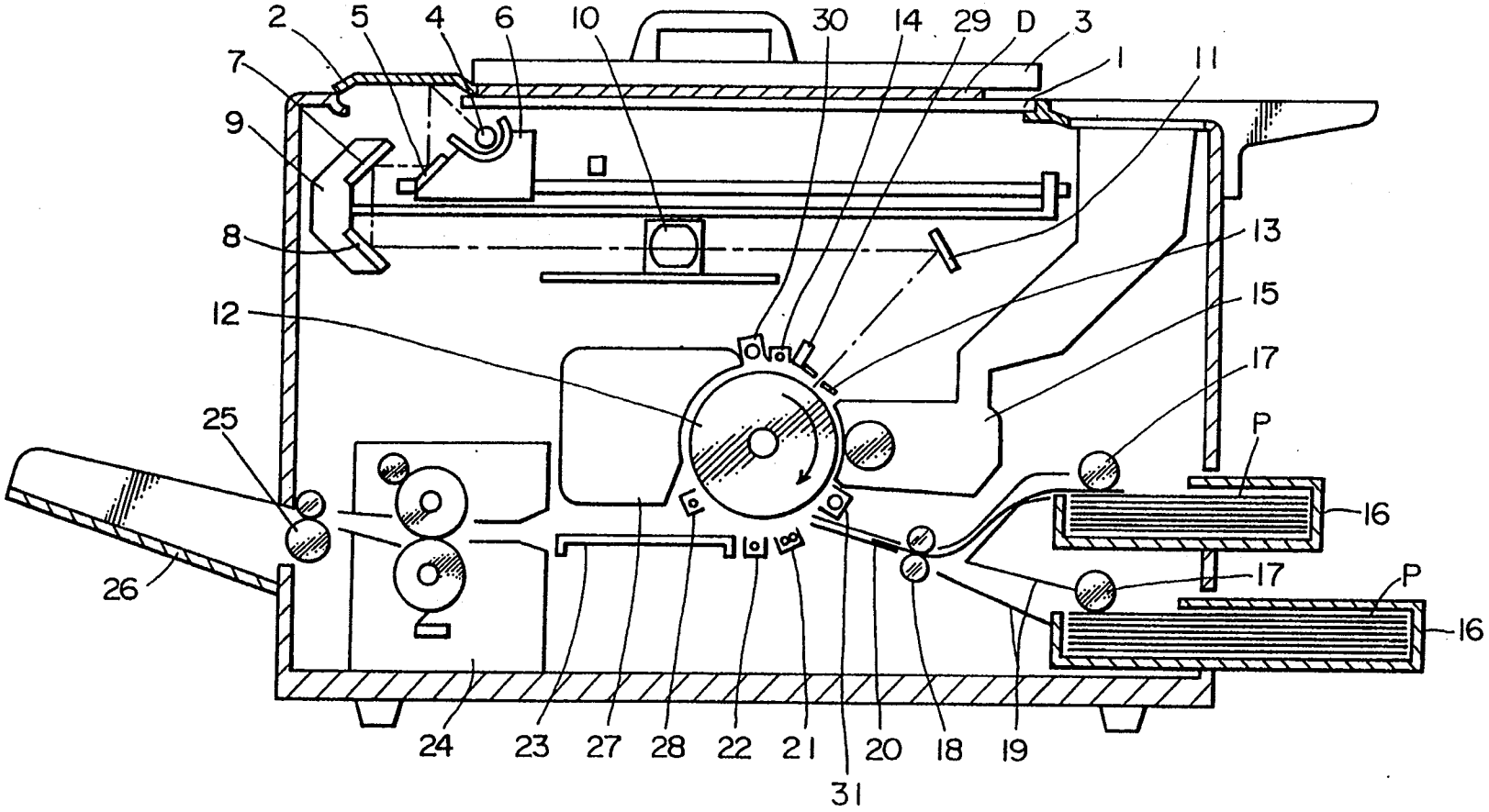
FIG. 6 PRIOR ART
FIG. 6 is a structural view of an electrophotographic reproducing apparatus as an example of the prior art.

In still another embodiment of the present invention shown in FIG. 5, the driving speed data of the optical system driving motor 100 determined in advance depending on the position of the paper cassette 56 are written into the non-volatile RAM 77 of the control unit 76, and CPU 78 reads out the data written into the non-volatile RAM 77 and sets them to the driving circuit 101. In FIG. 5, reference numeral 81 represents cassette selection means which includes a switch disposed on the main panel and selects whether transfer paper P of the upper paper cassette 56 or transfer paper P of the lower paper cassette 56 is to be supplied.

Next, the operation of the construction described above will be explained. The difference of this embodiment from the prior art example lies only in the operations of the optical system driving motor 100 and feed system driving motor and the rest of the operations are the same as those of the prior art examples; hence their explanations will be omitted.

The driving data of the optical system driving motor 100 are written into the non-volatile RAM 77 at the time of its assembly or maintenance so that the driving speed of the scanning system is in conformity with that of the feed system irrespective of the position of the paper cassette 56, in consideration of the load of the frictional resistance of the guide plates 59, 60, and the like.

First of all, the operator decides whether transfer paper P of the upper cassette 56 or transfer paper P of the lower paper cassette 56 is to be used by use of the cassette selection means 81. At this time the data of the selected paper cassette 56 are sent to CPU 78 and CPU 78 selects the data corresponding to the selected paper cassette 56 from the non-volatile RAM 77 and sends it to the driving circuit 101. The optical system driving motor 100 is driven on the basis of this data.

According to the construction described above, the driving speed of the feed system can be brought into conformity with that of the optical system irrespective of the set position of the paper cassette 56. Accordingly, no difference occurs between the length of the image of the document D in the feed direction obtained by scanning and the length of the image in the feed direction transferred onto transfer paper P.

In an apparatus having a temporary stacker for effecting double-face reproduction, too, deviation of the resulting image can be eliminated by writing those data which takes into consideration the frictional resistance of the feed path from the stacker to the photosensitive drum into the non-volatile RAM.

Furthermore, the present invention is not limited particularly to the reproducing apparatus but can of course be applied to other image forming apparatuses such as a laser beam printer.

According to the embodiment described above, the control means for controlling the driving means so that the feed speed of the feed means is in conformity with the driving speed of the scan driving means is disposed for each of a plurality of storage means. Therefore, it is possible to accomplish an image forming apparatus which does not generate the difference of the driving speed between the feed system and the scanning system irrespective of the positions of the storage means of the recording medium.

What is claimed is:

1. An apparatus comprising:

scanning means for scanning a document at a scanning speed to produce a document image having a length;

a first paper source having a first roller;

a second paper source having a second roller;

a paper conveying roller for conveying paper at a first speed from the first roller or at a second speed, different than the first speed, from the second roller to an image forming unit;

means for selecting either the first paper source or the second paper source; and control means for changing the scanning speed of the scanning means depending on the paper conveying speed, so that the length of the document image is independent of the paper conveying speed.

* * * * *